United States Patent [19]

York

[11] Patent Number: 4,581,598

[45] Date of Patent: Apr. 8, 1986

[54] SEGMENTED TOROIDAL AIR-CORE TRANSFORMER

[75] Inventor: Theodore H. York, Raleigh, N.C.

[73] Assignee: Westinghouse Electric Corp., Pittsburgh, Pa.

[21] Appl. No.: 622,292

[22] Filed: Jun. 19, 1984

[51] Int. Cl.[4] ..... H01F 5/00; H01F 27/30

[52] U.S. Cl. ..... 336/200; 29/602 R; 324/127; 324/142; 336/225; 336/229

[58] Field of Search ..... 324/142, 127, 107; 336/229, 200, 222, 223, 225, 206; 29/602 R, 605

[56] References Cited

U.S. PATENT DOCUMENTS 2,765,448 10/1956 Duffing ..... 336/229 X 2,907,968 10/1959 Thuik ..... 336/229 X

*Primary Examiner*—Thomas J. Kozma

*Attorney, Agent, or Firm*—L. P. Johns

[57] ABSTRACT

A toroidal air-core transformer characterized by substrates extending radially outwardly. Each substrate includes windings extending from one end to the other with each winding having a solder pad for connection with corresponding pads on the next adjacent segments.

9 Claims, 5 Drawing Figures

SEGMENTED TOROIDAL AIR-CORE TRANSFORMER

CROSS-REFERENCE TO RELATED APPLICATIONS

This application is related to application Ser. No. 622,291, filed June 19, 1984, by T. M. Heinrich and L. W. Frost, and assigned to the present assignee.

BACKGROUND OF THE INVENTION

1. Field of the Invention:

This invention relates to a toroidal air-core transformer and, more particularly, it pertains to such a transformer having a pluality of separate adjacent segments of dielectric substrates having windings secured thereto.

2. Description of the Prior Art:

Solid state watthour meters of current design include a toroidal air-core transformer with precise construction. One of the more promising designs for providing a toroidal winding is an accordion-pleated flexible printed circuit. Some difficulties have been encountered in establishing low cost and manufacturing reliability of the folded circuit toroid. An associated problem has been printed circuit manufacturing tolerances. The maximum dimension of the printed circuit component for the high number of turns is very large. Maintenance of tolerances over these dimensions in volume has been creating problems with printed circuit manufacturing.

In addition, since each turn includes a fold, the number of folds places tight limits on the allowed variability of each fold.

SUMMARY OF THE INVENTION

In accordance with this invention, it has been found that a toroidal air-core transformer may be provided which comprises a toroidial core having a plurality of juxtaposed segments of substrates which extend radially outwardly to an outer periphery forming a rosette-like cross-section. Each substrate consists of a dielectric material having opposite sides, opposite edges, and opposite ends. A winding is provided on each substrate and includes longitudinal and transverse portions on at least one side thereof and having a terminal at each end. Each terminal on each substrate is electrically connected to a corresponding terminal on an adjacent substrate so that a circuit extends through the interconnected windings of the assembled substrates.

A method of making an electrical sensor coil comprises the steps of providing a plurality of flexible insulating substrates having opposite sides, opposite edges, and opposite ends, applying an elongated electrical winding onto at least one side of the substrate and extending substantially from one end to the other end with the winding having longitudinal and transverse portions which latter portions are at generally equally spaced intervals, providing the winding with a terminal at each end on each substrate, and connecting each terminal on a substrate with a corresponding terminal on an adjacent substrate so as to provide continous circuit through the winding.

The advantage of the structure and method of this invention is that it not only allows lower cost manual assembly during early tests, but also provides a simpler equipment requirement for automatic reduction.

DESCRIPTION OF THE PREFERRED EMBODIMENTS

Figure 1:
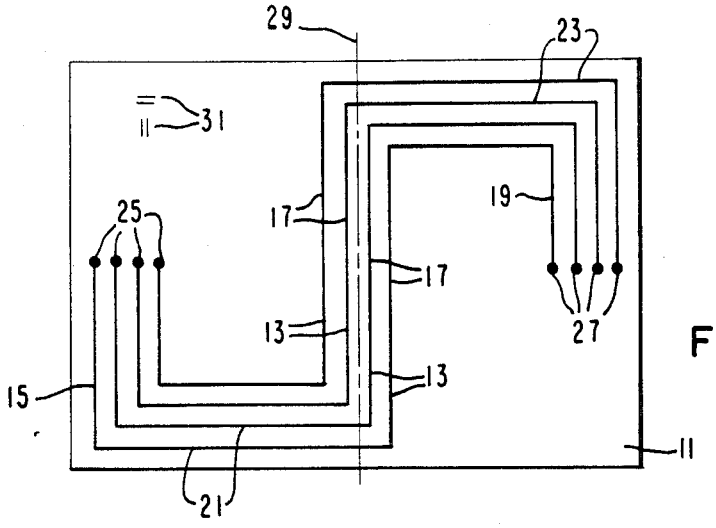
FIG. 1 is a plan view of a substrate segment having a winding printed thereon.

A segment of a sensor coil is shown in FIG. 1 and it comprises a substrate 11 having a number of spaced windings 13. Although a plurality of windings 13 are disclosed, it is understood that one or more such windings may be provided as required.

The substrate 11 is comprised of a dielectric material and is preferably pliable. A plurality of substrates 11 are provided for the purpose of this invention as set forth below.

Each winding 13 includes transverse portions 15, 17, 19 as well as longitudinal portion 21, 23. Small terminals or solder pads 25 are provided at one end of each winding at similar terminals or solder pads 27 are provided at the other end of each winding 13. The windings and terminals are preferably applied as printed circuits although other methods may be used.

Figure 2:
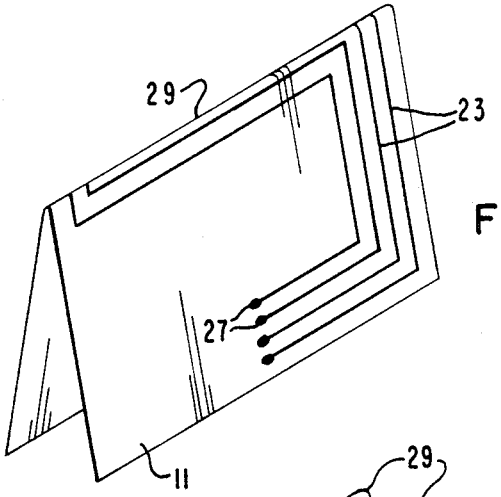
FIG. 2 is an isometric view of a substrate segment folded transversly.

After the windings 13 are applied, the substrate 11 is bent or folded to form a folded end 29 (FIG. 2). The substrate 11 is preferably folded into precisely two half portions and between spaced transverse portion 17 of the windings so that a pair of transverse portion 17 are disposed on opposite sides of the fold 29, thereby providing reverse polarities for the circuits passing therethrough. It is pointed out, however, that this invention is not limited to the specific pattern of longitudinal and transverse portions of the windings 13. Other patterns may be provided.

Figure 3:
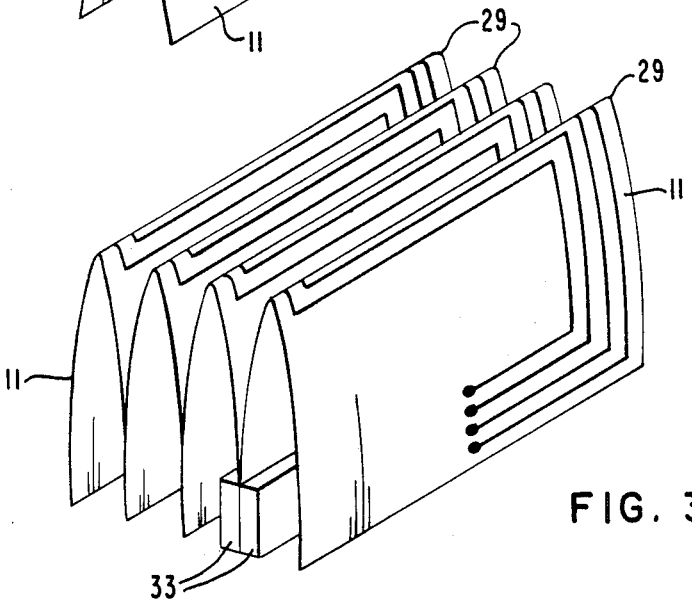
FIG. 3 is an isometric view showing how separate substrate segments are interconnected.

In accordance with this invention, the several separate segments 11 are assembled as shown in FIG. 3 with solder pads 25 of one substrate being aligned and joined with the solder pads 27 of the next adjacent substrate. For that purpose, alignment markings 31 are matched with similar markings on the next adjacent substrate to facilitate matching of the corresponding solder pads 25, 27 on the several substrates.

Figure 4:
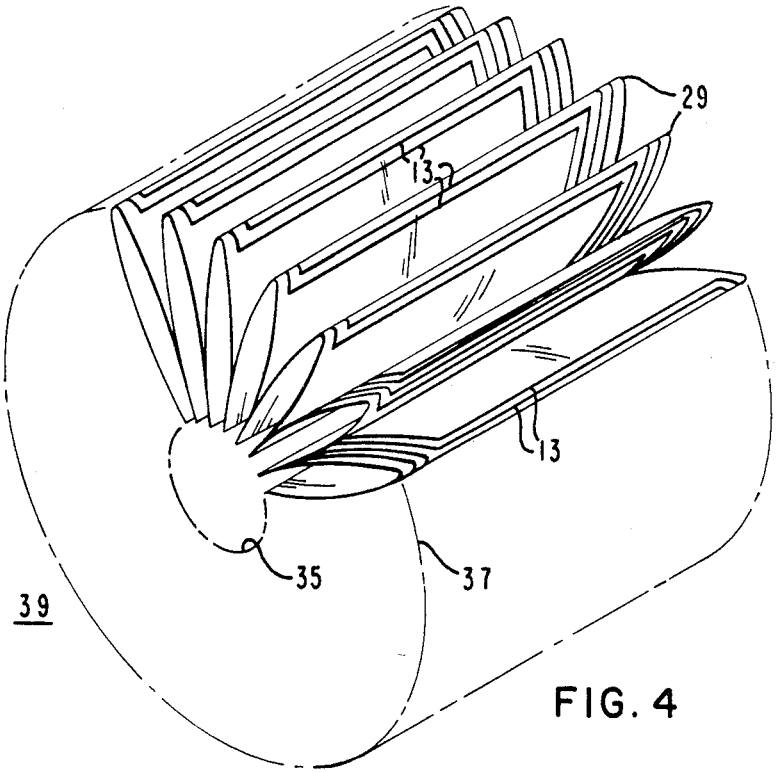
FIG. 4 is an isometric view showing a plurality of connected substrate segments disposed in the form of a sensor core.

The solder pads 25, 27 are joined by heating and pressing the solder pads together by a suitable soldering tool 33 until they are melded together. When the required number of substrates 11 are joined together as shown in FIG. 3, the inner joined ends are formed around an inner radius 35 until a toroidial figure is provided with the corresponding sides of the substrates 11 at opposite ends of the structure shown in FIG. 3 being joined to sustain the toroid configuration, forming a rosette-like cross-section, whereby the axes of the several folded rosette segments are radially disposed between the inner radius 35 and an outer radius 37. Accordingly, the toroidal configuration of FIG. 4 provides an effective band radius smaller than that practiced in the actual printed circuit material and makes a natural spacing easier to obtain.

As another embodiment of the invention, the folded ends 29 of the substrates 11 may be reversed in their final positions with the joined opposite ends where the solder pads 25, 27 are joined together. That is, the folded ends 29 are disposed on the inner radius 35 with the ends of the substrates including the solder pads being disposed at the outer radius 37.

Figure 5:
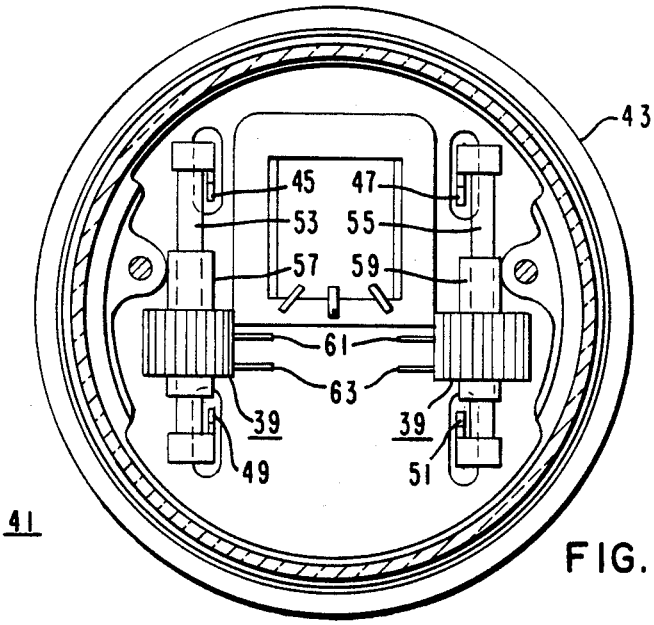
FIG. 5 is a front view with parts removed of an AC electric meter having a mutual inductance current sensing transducer.

One preferred form in which the sensor coil 39 is employed is shown in FIG. 5 in which an electronic watthour meter 41 is mounted on a mounting base 43. Line side hot wire connectors of three wire 240/120 volts service lines connect the voltage in current transmitted from an AC source, such as provided by a pull top distribution transformer, to blade terminals 45, 47, 49, 51. A pair of straight heavy primary conductors 53, 55 extend between corresonding pairs of blades.

The meter 41 comprises a pair of sensor coils 39. The conductor 53 extends through a bore or window of the unit 39 from which it is insulated by electrically insulative sleeve 57. Similarly, the conductor 55 extends through a bore or window of the second sensor coil 39 from which it is insulated by an insulative sleeve 59. Lead wires 61, 63 extend from the sensors 39, to a suitable electronic processing circuit. Additional shielding, such as shown in U.S. Pat. No. 4,413,230, may be employed as required.

It is noted that although the conductors 53, 55 are shown as passing only once through their respective windows, they may pass more than once, such as n times 2 give n times the output at leads 61, 63 or the same current flowing in each conductor.

In conclusion, the method and coil of this invention provides accurate coil geometry for applications where the conductor symmetry is conducive to minimize the sensitivity to the output to external fields. At the same time the design and construction method for that toroidal coil for use in a solid state watthour meter eliminates the multiple fold induced constraints on manufacturing procedures imposed by some prior coil constructions.

What is claimed is:

1. A toroidial air-core transformer comprising:

(a) a toroidal core including a plurality of juxtaposed segments of substrates extending radially outwardly to an outer periphery forming a rosette-like cross-section;

(b) each substrate comprising of a dielectric material having opposite sides, opposite edges, and opposite ends;

(c) a winding on each substrate including longitudinal and transverse portions on at least one side thereof and having a terminal at each end; and (d) each terminal on each substrate being electrically connected to a corresponding terminal on an adjacent substrate so that a circuit extends through the interconnected windings of the assembled substrates.

2. The transformer of claim 1 in which alternate adjacent pairs of segments are integral segments having a fold line of demarcation.

3. The transformer of claim 2 in which the fold line is substantially half-way between the opposite ends and extends between opposite edges.

4. The transformer of claim 3 in which the fold line is disposed at the outer periphery of the core.

5. The transformer of claim 4 in which the windings are located on the external side of the substrates.

6. The transformer of claim 5 in which the terminals of adjacent segments are bonded together.

7. The transformer of claim 4 in which the windings comprise a printed circuit and the terminals are solder pads.

8. The transformer of claim 7 in which the windings include a plurality of transverse portions and the fold line extends between and substantially parallel to said portions.

9. A toroidal air-core transformer comprising:

(a) a toroidal core including a plurality of separate segments of substrates extending radially outwardly forming rosette-like cross-section;

(b) each substrate being comprised of a dielectric material having opposite sides, opposite edges, and opposite ends;

(c) a winding on each substrate and including longitudinal and transverse portions on at least one side thereof and having a terminal at each end;

(d) each substrate being folded transversely into substantially two half-portions and adjacent to the transverse portions of the winding;

(e) each terminal on each substrate being electrically connected to a corresponding terminal on an adjacent substrate so that a circuit extends through the interconnected windings of the assembled substrates.

* * * * *